US005404816A

United States Patent [19]

Burri

[11] Patent Number: 5,404,816

[45] Date of Patent: Apr. 11, 1995

[54] RELEASABLE SABOT FOR A SUBCALIBER PROJECTILE

[75] Inventor: Jakob Burri, Zurich, Switzerland

[73] Assignee: Oerlikon-Contraves Pyrotec AG, Zurich, Switzerland

[21] Appl. No.: 286,196

[22] Filed: Aug. 8, 1994

[30] Foreign Application Priority Data

Sep. 24, 1993 [CH] Switzerland ..... 02891/93

[51] Int. Cl.[6] ..... F42B 14/06

[52] U.S. Cl. ..... 102/523; 102/520

[58] Field of Search ..... 102/520–523, 102/448, 450, 451, 452, 453, 456

[56] References Cited

U.S. PATENT DOCUMENTS

| | | | |
|---|---|---|---|
| 3,000,316 | 9/1961 | Dunlap et al. | 102/523 |
| 3,005,409 | 10/1961 | Dunlap et al. | 102/523 |
| 3,164,092 | 1/1965 | Reed et al. | 102/522 |
| 3,496,869 | 2/1970 | Engel . | |
| 4,142,467 | 3/1979 | Stahlman et al. | 102/523 |
| 4,546,705 | 10/1985 | Langenohl et al. . | |
| 4,653,404 | 3/1987 | Halverson | 102/522 |
| 4,735,147 | 4/1988 | Halverson | 102/522 |
| 4,776,280 | 10/1988 | Burri et al. . | |

FOREIGN PATENT DOCUMENTS

| | | |
|---|---|---|
| 0068397 | 1/1983 | European Pat. Off. . |
| 0288721 | 11/1988 | European Pat. Off. . |
| 1576031 | 6/1969 | France . |

*Primary Examiner*—Harold J. Tudor
*Attorney, Agent, or Firm*—Sandler Greenblum & Bernstein

[57] ABSTRACT

A releasable sabot for a subcaliber projectile. A relatively large danger zone exists for troops in which they can be injured by sabot splinters during the firing of subcaliber projectiles, with the releasable sabots, from a helically grooved weapon barrel, and in order to minimize this danger zone, the sabot of this invention is of a one piece plastic material construction and includes longitudinal slots and cooperative fracture point locations, wherein the longitudinal slots extend continuously from the sabot front end to the gastight region of the driving band, with the longitudinal slots, in cross section, having enlargements in the slot base regions.

5 Claims, 2 Drawing Sheets

FIG. 1
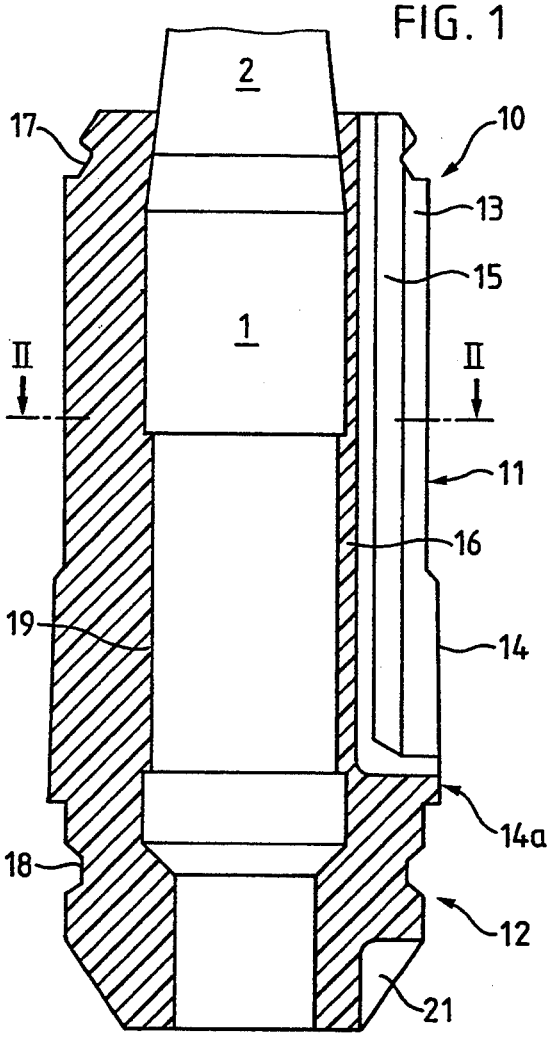
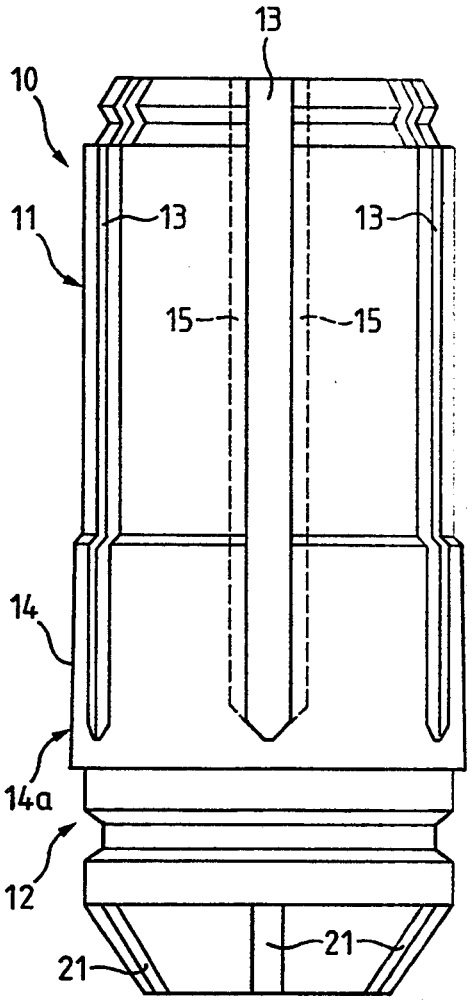
FIG. 3
FIG. 2
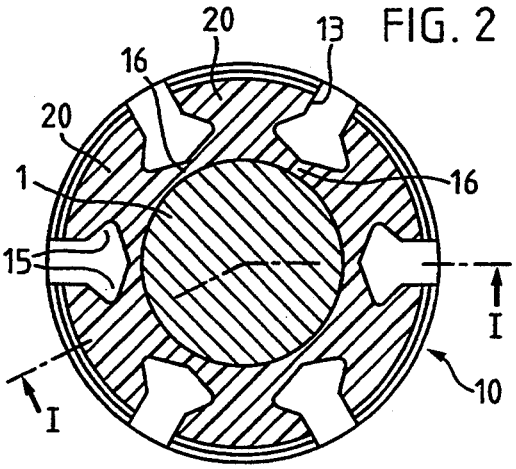

RELEASABLE SABOT FOR A SUBCALIBER PROJECTILE

BACKGROUND OF THE INVENTION

1. Field of the Invention

This invention pertains to a releasable sabot for a subcaliber projectile including a sabot jacket, a sabot rear portion and a driving band, the sabot having at least partial longitudinal slots and thereby having cooperative reference fracture locations.

2. Discussion of the Background of the Invention and Material Information

Subcaliber projectiles, also denominated as sabot projectiles, are most often fired from automatic weapons having helically grooved barrels wherein the required releasable sabots are, for example, take the form known from European Patent Publication EP-A-0 288 721.

This known sabot is comprised of a sabot rear portion, preferably of light metal construction, in which the projectile body or penetrator is anchored, and of a sabot jacket, preferably of plastic material, which surrounds the projectile body. Both of these portions include at least partial longitudinal slots together with their cooperating reference fracture locations, in order to achieve, during the separation of the sabot from the projectile body, at the exit from the weapons barrel, a segmentation of the formed securing band and the relatively large jacket segments. The remainder of the light metal sabot rear portion remains unitary and continues to fly, in the direction of the projectile body, for a considerable distance further than the previously noted segmented portions. Due to their mass, these splinters have such high energy levels so that overshooting of the troops is not safe, thus resulting in a relatively large danger zone.

SUMMARY OF THE INVENTION

The task to be achieved by the present invention is the creation of a releasable sabot, the use of which will drastically reduce the danger zone for the troops.

This task is solved by this invention by means of a releasable sabot for a subcaliber projectile including a sabot jacket, a sabot rear portion and a driving band, the sabot having at least partial longitudinal slots and thereby having cooperative reference fracture locations, the sabot being of a one piece construction and being constructed of a plastic material, with the longitudinal slots extending continuously from a front end of the sabot to a gastight region of the driving band, with the longitudinal slots, in cross section, having enlargements in base regions of the longitudinal slots.

A further embodiment of the releasable sabot of this invention includes a plurality of additional longitudinal slots in the sabot rear portion.

In another embodiment of this invention, the releasable sabot is constructed of a fiber reinforced plastic material, wherein the reinforcing fiber material is selected from the group consisting of glass, carbon and aramid fibers.

Through the use of a unitary construction or single piece sabot, particularly when fabricated of fiber reinforced plastic material and having a special arrangement and configuration of its longitudinal slots which cooperate with respective reference fracture locations, the danger zone is substantially reduced as a result of smaller, low energy splinters consisting only of plastic material, with the sabot rear portion also breaking up. In addition, this configuration provides the following advantages:

Smaller splinters permit a better separation process, i.e., lower transient pulses act on the projectile body;

Weight reduction without loss of rigidity; and

Due to the now available possibility of axial mold opening, as a result of the continuous longitudinal slots, the use of multiple injection tools is now feasible, thus resulting in lower production costs.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein:

FIG. 1 is a longitudinal section, taken along line I—I of FIG. 2, of a subcaliber projectile having the releasable sabot of this invention;

FIG. 2 is a cross section, taken along line II—II of FIG. 1;

FIG. 3 is a side view of the releasable sabot of this invention as shown in FIG. 1.

DETAILED DESCRIPTION OF THE PREFERRED EMBODIMENTS

Figure 4:
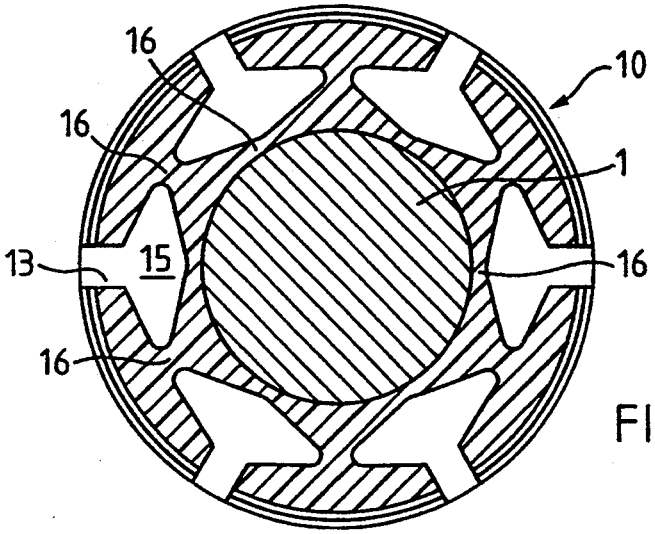
FIGS. 4, 5, and 6, each are an enlarged cross section, corresponding to that of FIG. 2, of additional variations thereof.

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

FIGS. 1 and 2 only partially illustrate a subcaliber projectile which includes a projectile body 1, preferably of a heavy metal construction, having a ballistic cover 2 affixed thereon, as well as the one piece or unitary releasable sabot 10 of this invention, also shown in FIG. 3, with sabot 10 including a sabot jacket 11 and a sabot rear portion 12. Longitudinal grooves or slots 13 are uniformly arranged and spaced around the circumference of sabot 10 and extend continuously from the front end of the sabot (from the top of FIGS. 1 and 2) up to the gastight region **14*a* at the end of a driving band 14, with slots 13, in cross section, having enlargements 15 in the slot base region. Therewith, segments 20 are formed which are connected together via corresponding reference fracture locations 16, six in number, as per FIG. 2, for example. In addition, preferably additional channels or slots 21 are provided, on sabot rear portion 12, for the formation of additional reference fracture locations. Furthermore, although not significant for the invention, sabot 10 includes, near its front end, a circumferential groove 17, and at the circumference of sabot rear portion 12, an attachment means 18 for the non-illustrated but however well known protective cover or cartridge case, with the projectile body 1 being, for example, attached to sabot 10 via flutes, channels or grooves 19**.

Preferably, sabot 10 is constructed of fiber-reinforced plastic material, such as, for example PEI (Polyetherimide), PEEK (Polyetheretherketone) or PPS (Polyphenylenesulfide), with glass, carbon, and/or aramid fibers, wherein a mixture of differing fibers can also be utilized.

Figure 5:
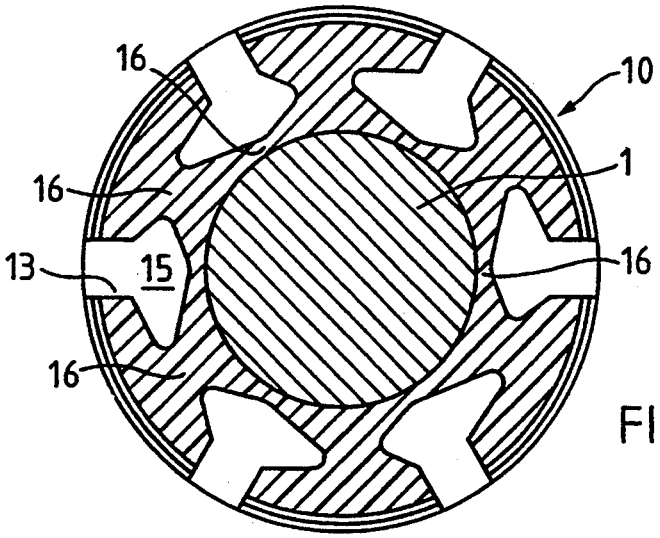
Figure 6:
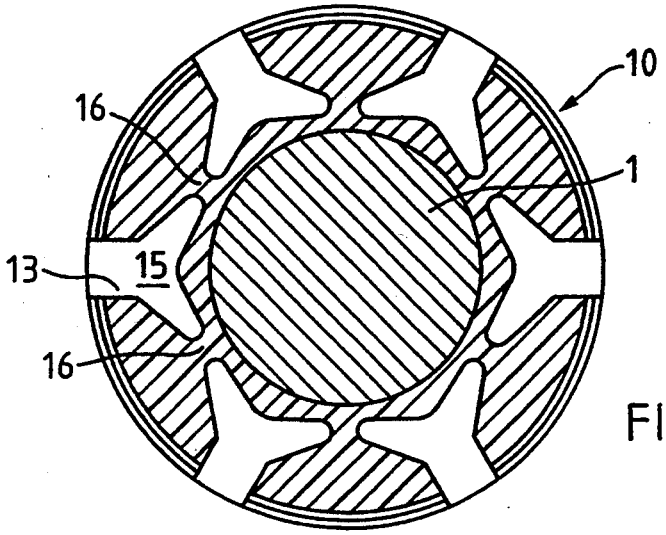

FIGS. 4, 5 and 6 show additional preferred embodiments of slot or channel enlargements 15 and the corresponding increase in fracture locations 16 in sabot 10 for the reduction of the resulting splinters during the release of sabot 10 from projectile body 1.

The fracture locations extend in at least one of a chordal and radial direction as illustrated in FIGS. 2 and 4–6.

The desired drastic reduction of the size of the danger zone is achieved by means of the noted enlargements 15 in the slot base region and the cooperating reference fracture locations 16 as well as the plastic material selection which results in smaller plastic splinters during the release of sabot 10 from the projectile body 1, thus resulting in a considerably shorter flight distance of the lighter splinters.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A releasable sabot for a subcaliber projectile including a sabot jacket, a sabot rear portion and a driving band, the sabot having at least partial longitudinal slots, the slots being uniformly arranged and spaced around an outer circumference of the sabot and extending radially inwardly from the outer circumference, and thereby having cooperative reference fracture locations in slot base regions thereof, the sabot being of a one piece construction and being constructed of a plastic material, with the longitudinal slots extending continuously from a front end of the sabot to a gastight region of the driving band, with the longitudinal slots, in cross section, having enlargements in the base regions of the longitudinal slots, thereby producing reference fracture locations extending in at least one of a chordal and radial direction.

2. A releasable sabot for a subcaliber projectile including a sabot jacket, a sabot rear portion and a driving band, the sabot having at least partial longitudinal slots, the slots being uniformly arranged and spaced around an outer circumference of the sabot and extending radially inwardly from the outer circumference, and thereby having cooperative reference fracture locations in slot base regions thereof, the sabot being of a one piece construction and being constructed of a plastic material, with the longitudinal slots extending continuously from a front end of the sabot to a gastight region of the driving band, with the longitudinal slots, in cross section, having enlargements in the base regions of the longitudinal slots, thereby producing reference fracture locations extending in at least one of a chordal and radial direction, with the sabot being constructed of a fiber reinforced plastic material.

3. The releasable sabot of claim 2, wherein the reinforcing fiber material is selected from the group consisting of glass, carbon and aramid fibers.

4. A releasable sabot for a subcaliber projectile including a sabot jacket, a sabot rear portion and a driving band, the sabot having at least partial longitudinal slots, the slots being uniformly arranged and spaced around an outer circumference of the sabot and extending radially inwardly from the outer circumference, and thereby having cooperative reference fracture locations in slot base regions thereof, the sabot being of a one piece construction and being constructed of a plastic material, with the longitudinal slots extending continuously from a front end of the sabot to a gastight region of the driving band, with the longitudinal slots, in cross section, having enlargements in the base regions of the longitudinal slots, thereby producing reference fracture locations extending in at least one of a chordal and radial direction, with the sabot being constructed of a fiber reinforced plastic material, the sabot further including a plurality of additional longitudinal slots in the sabot rear portion.

5. The releasable sabot of claim 4, wherein the reinforcing fiber material is selected from the group consisting of glass, carbon and aramid fibers.

* * * * *